US011781375B1

(12) United States Patent
Steademan et al.

(10) Patent No.: US 11,781,375 B1
(45) Date of Patent: Oct. 10, 2023

(54) FENESTRATION UNIT WITH PANEL FRAME HAVING CORNER REINFORCEMENT PLUG

(71) Applicant: JELD-WEN, Inc., Charlotte, NC (US)

(72) Inventors: Anna Michelle Steademan, Klamath Falls, OR (US); David Paul Belau, Klamath Falls, OR (US)

(73) Assignee: JELD-WEN, Inc.

( * ) Notice: Subject to any disclaimer, the term of this patent is extended or adjusted under 35 U.S.C. 154(b) by 0 days.

(21) Appl. No.: 17/655,012

(22) Filed: Mar. 16, 2022

(51) Int. Cl.
*E06B 3/96* (2006.01)
*E06B 3/968* (2006.01)

(52) U.S. Cl.
CPC ..... *E06B 3/9685* (2013.01); *E06B 3/962* (2013.01)

(58) Field of Classification Search
CPC ..... E06B 3/9612; E06B 3/9616; E06B 3/962; E06B 3/964; E06B 3/9645; E06B 3/9647; E06B 3/9648; E06B 3/9681; E06B 3/9682; E06B 3/9685
See application file for complete search history.

(56) References Cited

U.S. PATENT DOCUMENTS 3,304,108 A * 2/1967 Hamilton ..... F16L 41/025 52/843
6,503,020 B1 * 1/2003 Mascioletti ..... E04B 1/2604 403/231
6,881,005 B2 * 4/2005 Sosa ..... E06B 11/02 403/395
7,967,401 B2 * 6/2011 Hsu ..... A47B 47/0033 312/111
9,827,522 B2 * 11/2017 Simmons ..... F16B 37/16
11,499,365 B2 * 11/2022 Feil ..... E06B 3/9687
2005/0193680 A1 * 9/2005 Wang ..... E06B 3/9688 52/656.9

FOREIGN PATENT DOCUMENTS

CN 109538079 A * 3/2019
CN 111594008 A * 8/2020
EP 3467249 A1 * 4/2019
KR 1748089 B1 * 6/2017 ..... E06B 3/9628
WO WO-2019213699 A1 * 11/2019 ..... B25B 5/068

OTHER PUBLICATIONS

Greenteq, "Weldable Corner Connectors," www.vbh.de, May 2013.

* cited by examiner

*Primary Examiner* — Ryan D Kwiecinski
(74) *Attorney, Agent, or Firm* — LKGlobal | Lorenz & Kopf, LLP

(57) ABSTRACT

A frame for a fenestration unit includes a corner member at a corner joint of first and second elongate frame members. The second elongate frame member includes a profile member and an elongate reinforcement beam disposed therein. The elongate reinforcement beam has a terminal end. The second elongate frame member further includes a corner reinforcement plug with an insert end that is received in the terminal end of the elongate reinforcement beam. The corner reinforcement plug also includes a corner end that is engaged with the corner member and an intermediate portion that is disposed between the insert end and the corner end. The corner reinforcement plug has a shoulder at a transition between the intermediate portion and the insert end, and the shoulder abuts against the terminal end. The intermediate portion is disposed within the interior of the profile member.

20 Claims, 6 Drawing Sheets

FENESTRATION UNIT WITH PANEL FRAME HAVING CORNER REINFORCEMENT PLUG

TECHNICAL FIELD

The present disclosure generally relates to a fenestration unit and, more particularly, relates to a fenestration unit with a panel frame having a corner reinforcement plug.

BACKGROUND

A fenestration unit may include a frame (e.g., a rectangular frame) that supports one or more other members of the unit. For example, a panel of the fenestration unit (e.g., an active panel of a slider door or a window unit) may include a frame that supports a glazing unit, a door skin, or other component of the panel.

There are various frame configurations for different types of fenestration units. However, some frame configurations may be limited under some conditions. For example, some frame configurations may not be able to support some types of glazing units. Furthermore, manufacture and/or assembly of these fenestration units may be inefficient and costly. Additionally, it may be difficult to make these frames aesthetically pleasing.

Thus, it is desirable to provide an improved fenestration unit that is highly robust under a number of conditions. It is also desirable to provide a fenestration unit that may be manufactured efficiently. Furthermore, it is desirable to provide this fenestration unit with aesthetically pleasing features. Other desirable features and characteristics of the present disclosure will become apparent from the subsequent detailed description and the appended claims, taken in conjunction with the accompanying drawings and this background discussion.

BRIEF SUMMARY

In one embodiment, a frame for a fenestration unit is disclosed that includes a corner member and a first elongate frame member extending from the corner member in a first direction. The fenestration unit also includes a second elongate frame member extending from the corner member in a second direction that is different from the first direction. The second elongate frame member includes a profile member defining an interior and an elongate reinforcement beam disposed within the interior. The elongate reinforcement beam has a terminal end. The second elongate frame member further includes a corner reinforcement plug with an insert end that is received in the terminal end of the elongate reinforcement beam. The corner reinforcement plug also includes a corner end that is engaged with the corner member and an intermediate portion between the insert end and the corner end. The corner reinforcement plug has a shoulder defined between the intermediate portion and the insert end, and the shoulder abuts against the terminal end. The intermediate portion is disposed within the interior of the profile member.

In another embodiment, a method of manufacturing a fenestration unit is disclosed. The method includes coupling a corner member of a frame of the fenestration unit to a first elongate frame member so that the first elongate frame member extends from the corner member in a first direction. The method also includes coupling a second elongate frame member to the corner member so that the second elongate frame member extends from the corner member in a second direction that is different from the first direction. The second elongate frame member includes a profile member defining an interior and an elongate reinforcement beam disposed within the interior. The elongate reinforcement beam has a terminal end. The second elongate fame member also includes a corner reinforcement plug with an insert end that is received in the terminal end of the elongate reinforcement beam, a corner end that is engaged with the corner member, and an intermediate portion between the insert end and the corner end. The corner reinforcement plug has a shoulder defined between the intermediate portion and the insert end. The shoulder abuts against the terminal end, and the intermediate portion is disposed within the interior of the profile member.

In an additional embodiment, a panel for a fenestration unit is disclosed. The panel includes a central portion and a panel frame that extends about the central portion and that supports the central portion. The panel frame includes a corner member with a projection. The panel frame also includes a first elongate frame member extending from the corner member in a first direction. The panel frame further includes a second elongate frame member extending from the corner member in a second direction that is different from the first direction. The projection is disposed at a nonzero miter angle relative to the first direction and the second direction. The second elongate frame member includes a profile member defining an interior. The second elongate frame member also includes an elongate reinforcement beam disposed within the interior. The elongate reinforcement beam has a terminal end. The second elongate frame member further includes a corner reinforcement plug with an insert end that is received in the terminal end of the elongate reinforcement beam, a corner end with an aperture that receives the projection to engage the corner member, and an intermediate portion between the insert end and the corner end. The corner reinforcement plug has a shoulder defined between the intermediate portion and the insert end, and the shoulder abuts against the terminal end. The intermediate portion is disposed within the interior of the profile member.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1:
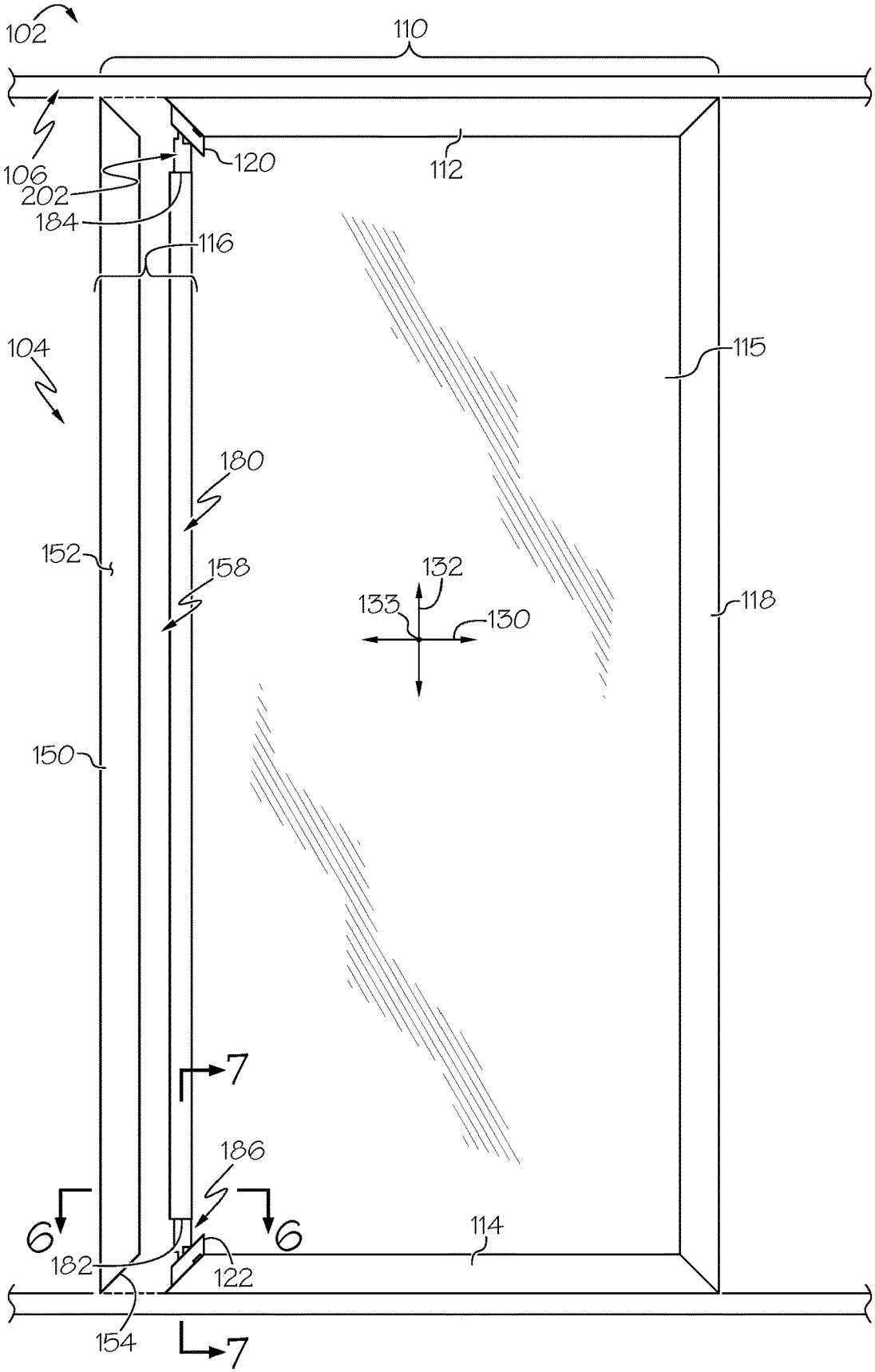
FIG. 1 is a partly exploded plan view of a fenestration unit according to example embodiments of the present disclosure.

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include an improved frame for a fenestration unit. The frame may include at least one corner member (at least one corner key) at a corner joint between a first and second elongate frame member (i.e., a rail member and a stile member) of the frame. At least one of the first and second elongate frame members may be a "composite elongate frame member" that includes a plurality of elongate members with at least one elongate member received in another. The composite elongate frame member may include a profile member that covers over and receives an elongate reinforcement beam extending along an interior thereof. Also, a corner reinforcement plug may extend between a terminal end of the elongate reinforcement beam and the corner key. An insert end of the plug may be received in the terminal end of the beam and the plug may include a corner end that engages the corner key. An intermediate portion of the plug may extend between the insert end and the corner end and may be exposed to the interior surfaces of the profile member.

In some embodiments, the corner key may include features that receive the corner end of the plug. One or more surfaces of the plug may overlie, engage, and/or abut against a face of the corner key. Also, the corner end of the plug may include an aperture, recess, opening, cup, or other feature that receives a projection of the corner key. In some embodiments, the end of the plug may include a groove that receives a rail of the corner key. Thus, the joint defined between elongate frame members may include surfaces, interlocking features, and/or engaging portions of the plug and the corner key. This joint may be disposed at a miter angle at the corner of the frame.

Furthermore, the insert end of the plug may be received in the open longitudinal end of the reinforcement beam. The insert end may include faces that frictionally engage the inner surface of the reinforcement beam.

Additionally, the intermediate portion of the plug may have a greater width than the insert end. A shoulder may be defined at a transition between the insert end and the intermediate portion. The shoulder may provide a limiting surface for limiting insertion of the plug into the reinforcement beam. The shoulder may also abut against the end of the reinforcement beam to provide support thereto when the frame is assembled together.

Also, the intermediate portion of the plug may include one or more side surfaces. These side surfaces may be substantially flat (i.e., flat within reasonable manufacturing tolerances) in some embodiments. In some embodiments, the side surfaces may be substantially flush with adjacent side surfaces of the beam and/or the corner key such that these surfaces cooperatively define a largely continuous surface configured to support the profile member. These surfaces may oppose the corresponding interior surface of the profile member for abutting, frictionally engaging, or otherwise supporting corresponding interior surfaces of the profile member.

The corner reinforcement plug and other related features of the present disclosure may make the frame highly robust. The corner reinforcement plug may transfer and disperse applied loads to the top and bottom rails of the panel frame. The corner reinforcement plug may help distribute loads at the corner of frame. The plug may distribute loads more evenly between the reinforcement beam, the corner key, and/or the profile member. The plug may reduce point loading and make the frame strong and robust. Additionally, the frame of the fenestration unit may be constructed and assembled in an efficient manner. The frame may also have relatively low profile (i.e., compact profile) and may be aesthetically pleasing.

Referring to FIG. 1, a fenestration unit 102 is illustrated. The fenestration unit 102 may be configured in a number of ways without departing from the scope of the present disclosure. The fenestration unit 102 may be configured for a building, dwelling, house, etc. The fenestration unit 102 may be configured with a relatively flat, rectangular panel 104 that is supported within an exterior frame 106. In some embodiments, the panel 104 may be supported for sliding movement (e.g., horizontal sliding movement) within the frame 106. The panel 104 may be a sliding door panel in some embodiments. However, it will be appreciated that features of the present disclosure may be incorporated into a window or another fenestration unit without departing from the scope of the present disclosure.

The panel 104 of the fenestration unit 102 may include a panel frame 110. The panel frame 110 may be rectangular and may include an upper rail 112 and a lower rail 114, which are joined by a first stile 116 and a second stile 118. The first stile 116 is shown partly disassembled in FIG. 1 to expose interior components according to example embodiments.

The first and second stiles 116, 118 may be separated along a horizontal direction (i.e., along a transverse axis 130 of the panel 104). The upper and lower rails 112, 114 may be separated along a vertical direction (i.e., along a vertical axis 132). The panel 104 may also define an inside face and an outside face that are separated along an axis 133. These axes 130, 132, 133 may be normal to each other and may define a Cartesian coordinate system in some embodiments.

The upper rail 112 and the lower rail 114 may be supported for sliding movement along the transverse axis 130 by the exterior frame 106. For example, the exterior frame 106 may include upper and lower tracks, and the upper and lower rails 112, 114 may be supported by one or more roller supports or other components for sliding movement along the transverse axis 130.

The panel frame 110 may also support a central portion 115 of the panel 104. The central portion 115 may include a glazing unit in some embodiments. In additional embodiments, the central portion 115 may include a door skin or other component supported by the panel frame 110.

Features of the first stile 116 (i.e., a first elongate frame member) may be connected to the upper rail 112 (i.e., a second elongate frame member) via an upper corner key 120 (i.e., an upper corner member). Similarly, the first stile 116 may be connected to the lower rail 114 (i.e., a third elongate frame member) via a lower corner key 122 (i.e., a lower corner member). The joint of the fenestration unit 102 at the lower corner key 122 is illustrated in detail in FIG. 2 according to example embodiments. The joint at the upper corner key 120 may be substantially similar to the embodiments represented in FIG. 2. It will be appreciated that the second stile 118 may include similar upper and/or lower joints for joining to the upper and lower rails 112, 114. It will also be appreciated that the joint illustrated in FIG. 2 may be utilized at another corner position of the frame 110 without departing from the scope of the present disclosure.

Figure 2:
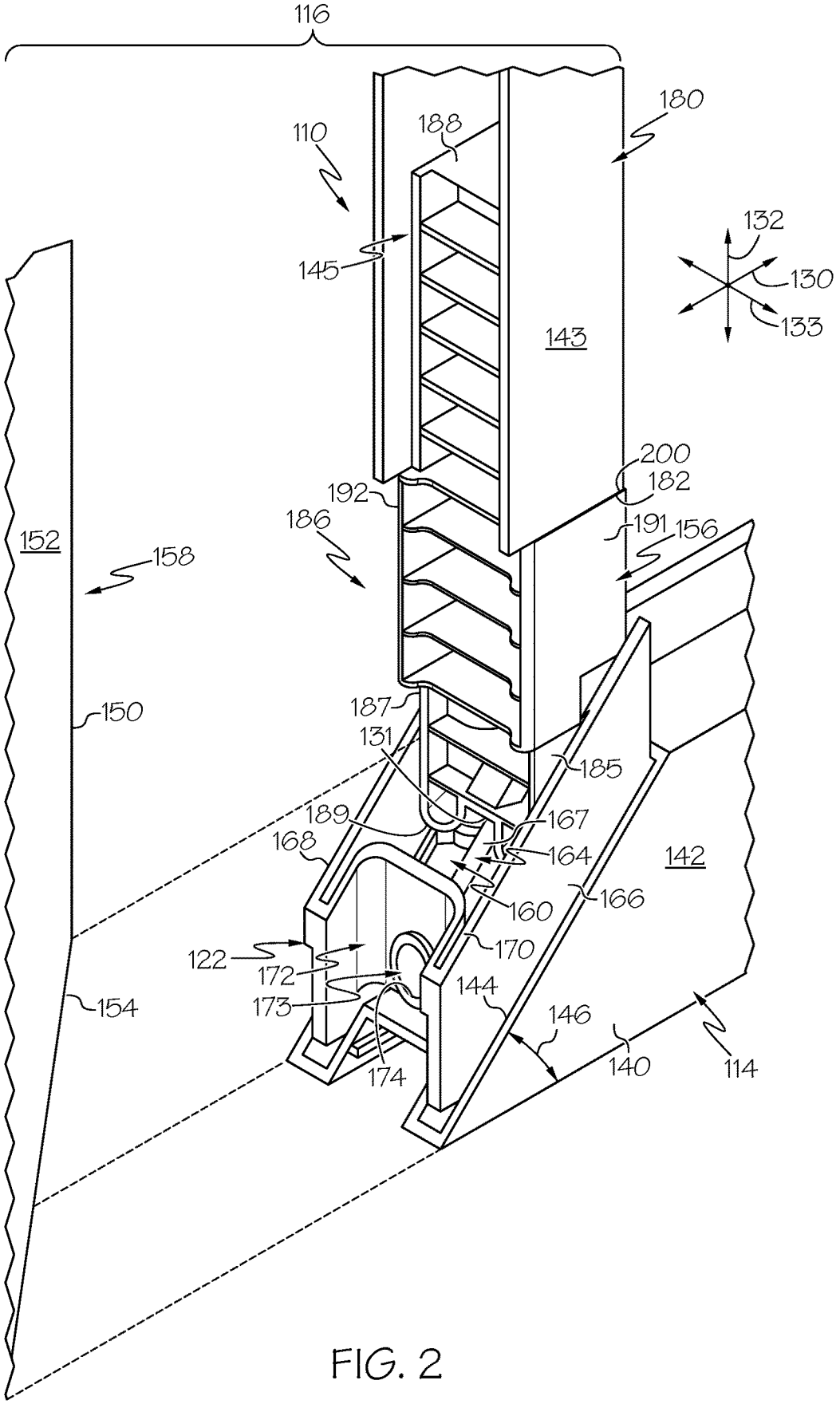
FIG. 2 is an exploded perspective view of a corner area of the fenestration unit of FIG. 1 of the present disclosure.

As shown in FIG. 2, the lower corner key 122 (hereinafter "corner key 122") may be a unitary, L-shaped block that is composed of or includes a polymeric material (e.g., nylon). The corner key 122 may include an interior side face 166 and an exterior side face 168. The corner key 122 may also include an engagement face 160 for engaging one or more components of the first stile 116. Although not shown, the corner key 122 may further include an engagement face for engaging one or more components of the lower rail 114. In the illustrated embodiment, the engagement face 160 is disposed substantially at a miter angle 146 relative to the horizontal direction (i.e., along the transverse axis 130). In some embodiments, the miter angle 146 may be approximately forty-five degrees (45°). The engagement face 160 may be recessed to define an edge wall 170 of the corner key 122. The edge wall 170 may extend upward vertically along the vertical axis 132 and may border the inclined engagement face 160. Accordingly, the edge wall 170 may provide the engagement face 160 with a cupped arrangement for receiving one or more components of the first stile 116. The top rim of the edge wall 170 may also extend along the miter angle 146.

The lower corner key 122 may also include a side recess 172, which may be open outward along the axis 130. In some embodiments, the lower corner key 122 may include at least one defined passages, such as an internal passage 173. The internal passage 173 may be a cylindrical passage that extends through the corner key 122, from an injection aperture 174 in the side recess 172 to one or more outlets (not shown). As will be discussed, during assembly of the fenestration unit 102, a sealant may be injected into the aperture 174 from the exterior, the sealant may flow along the passage 173, and the sealant may flow out and around the corner key 122 to seal gaps, etc. in the corner of the fenestration unit 102. The upper corner key 120 and/or other corner keys of the fenestration unit 102 may be substantially similar to the lower corner key 122.

The engagement face 160 may include a projection 164. In some embodiments, the projection 164 may project vertically upward from the face 160 along the vertical axis 132. The projection 164 may be an elongate ridge 167 that extends along the face 160, such that the ridge 167 extends upward along the miter angle 146. The ridge 167 may extend linearly along a straight axis defined along the face 160 and along the miter angle 146. The straight axis of the ridge 167 may be oblique to the transverse axis 130 and the vertical axis 132.

Furthermore, as shown in FIG. 2, the lower rail 114 may include a lower rail profile member 140. The lower rail profile member 140 may be a thin-walled, hollow, elongate member that defines a lower rail outer surface 142 of the frame 110. In some embodiments, the lower rail profile member 140 may be constructed from a composite of wood product (e.g., wood fibers) and a resin material. The lower rail profile member 140 may have some flexibility so as to slightly flex under normal loads without damage. The lower rail profile member 140 may be an extrusion (i.e., an elongate, extruded article that is extruded along an extrusion direction). The lower rail profile member 140 may include a terminal end 144 that covers over a portion of the lower corner key 122 as shown in FIG. 2. The terminal end 144 may be disposed approximately at the miter angle 146 relative to the axis 130, leaving another portion of the lower corner key 122 exposed therefrom.

Figure 6:
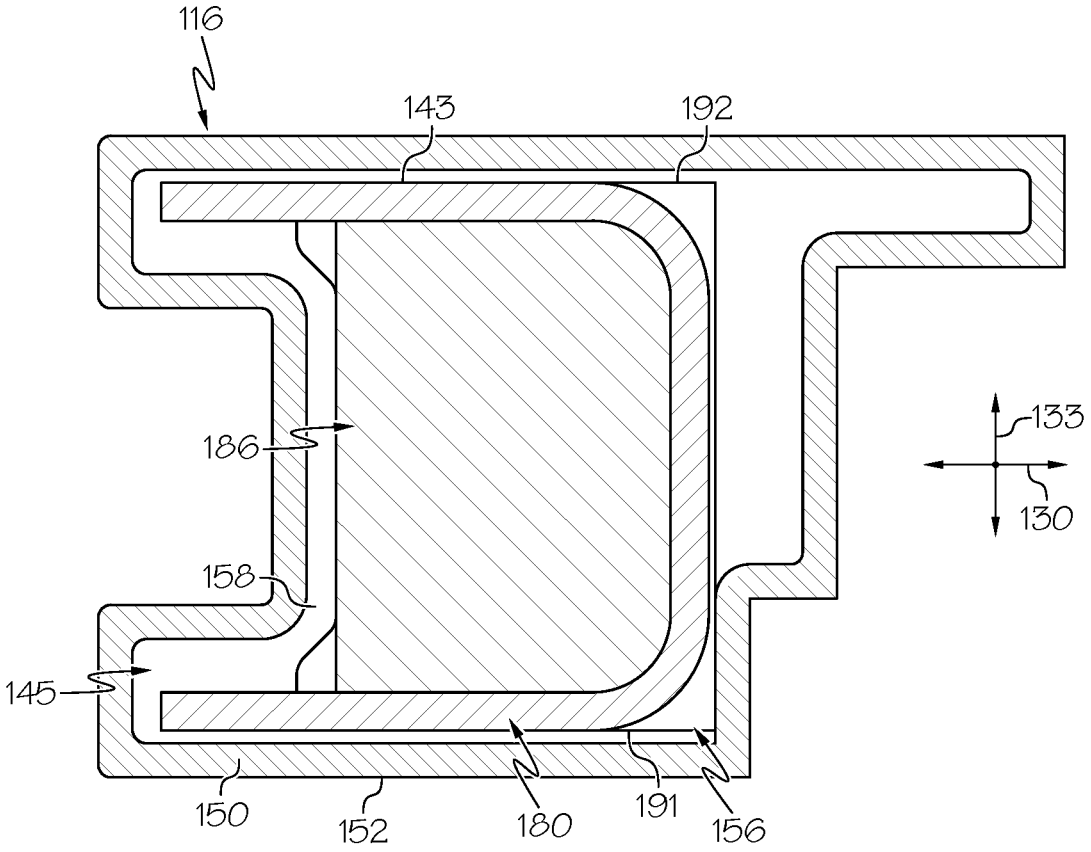
FIG. 6 is a cross sectional view of the fenestration unit taken along the line 6-6 of FIG. 1 according to example embodiments.

The first stile 116 may include a stile profile member 150 (FIGS. 1 and 2), which may be similar to the lower rail profile member 140. Thus, the stile profile member 150 may be a thin-walled, hollow, somewhat flexible elongate member that defines a stile outer surface 152 of the frame 110. FIG. 6 illustrates an outer profile shape of the lower rail profile member 140 according to example embodiments and, as shown, the lower rail profile member 140 may be hollow with the stile outer surface 152 defining surfaces facing along (i.e., normal to) the interior-exterior axis 133 as well as surfaces facing along the transverse axis 130. In some embodiments, the stile profile member 150 may be constructed, composed, or made from a composite of wood product (e.g., wood fibers) and a resin material. The stile profile member 150 may be an extrusion (i.e., an extruded part). The stile profile member 150 may include a mitered end 154 (FIGS. 1 and 2) that is disposed at the miter angle 146 to correspondingly fit to the lower rail profile member 140. The mitered end 154 of the stile profile member 150 may abut against the mitered terminal end 144 of the rail profile member 140 to minimize any gaps therebetween.

The stile profile member 150 may extend vertically between the lower corner key 122 and the upper corner key 120 (FIG. 1). The stile profile member 150 may be hollow and an interior 158 of the stile profile member 150 may receive the lower corner key 122, the upper corner key 120, and one or more internal components discussed below.

The first stile 116 may include a reinforcement beam 180 as shown in FIGS. 1 and 2. The reinforcement beam 180 may be an elongate, rigid, and strong member that extends vertically along the first stile 116 and along the vertical axis 132. In some embodiments, the reinforcement beam 180 may be constructed, composed, and/or made from a strong and lightweight metal, such as steel (e.g., 12-gauge steel). In some embodiments, the reinforcement beam 180 may be hollow and/or may be a thin-walled article. For example, the reinforcement beam 180 may have a U-shaped or C-shaped cross section (FIG. 6). The reinforcement beam 180 may include a lower terminal end 182 and an upper terminal end 184, both of which may be open along the vertical axis 132. The reinforcement beam 180 may extend substantially continuously between the lower terminal end 182 and the upper terminal end 184. In some embodiments, the reinforcement beam 180 may be roll-formed, extruded, or otherwise constructed. The reinforcement beam 180 may be formed of metal, such as steel. As shown in FIGS. 2 and 6, an outer side 145 of the reinforcement beam 180 may be open outward along the transverse axis 130 and open toward the interior 158 of the stile profile member 150.

The reinforcement beam 180 may include relatively flat outer surfaces 143. These outer surfaces 143 may correspond to those of the stile profile member 150. Accordingly, the interior surface of the stile profile member 150 may be layered over, may overlie, and may be closely adjacent to the flat outer surfaces 143 of the reinforcement beam 180. The outer surfaces 143 may, in some conditions abut against the opposing inner surfaces of the stile profile member 150 to provide support. As such, the reinforcement beam 180 may provide robust internal support to the profile member 150 as well as providing support for the central portion 115 of the panel 104.

Figure 3:
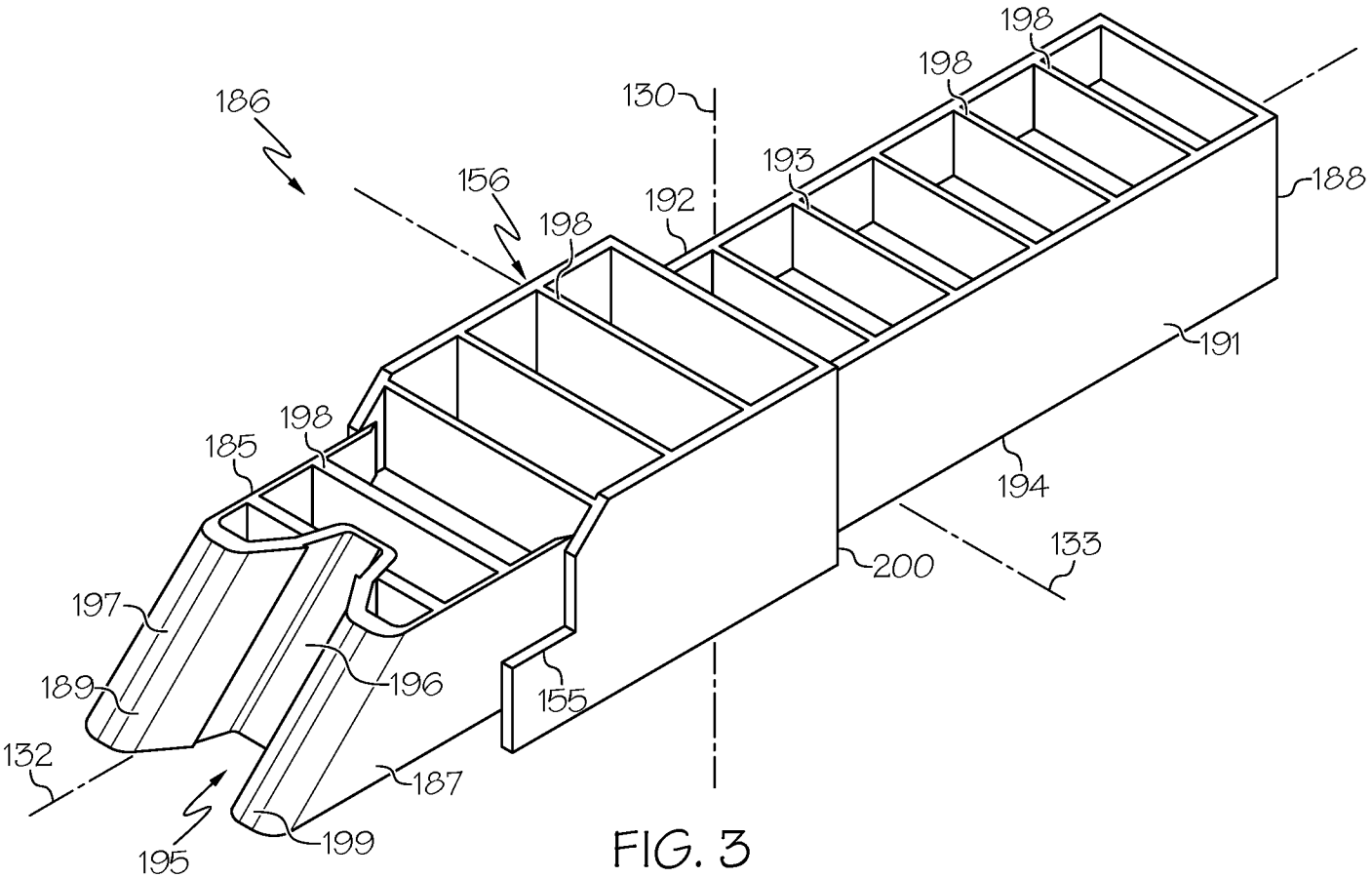
FIG. 3 is a perspective view of a plug member of the fenestration unit of FIG. 1 according to example embodiments of the present disclosure.
Figure 4:
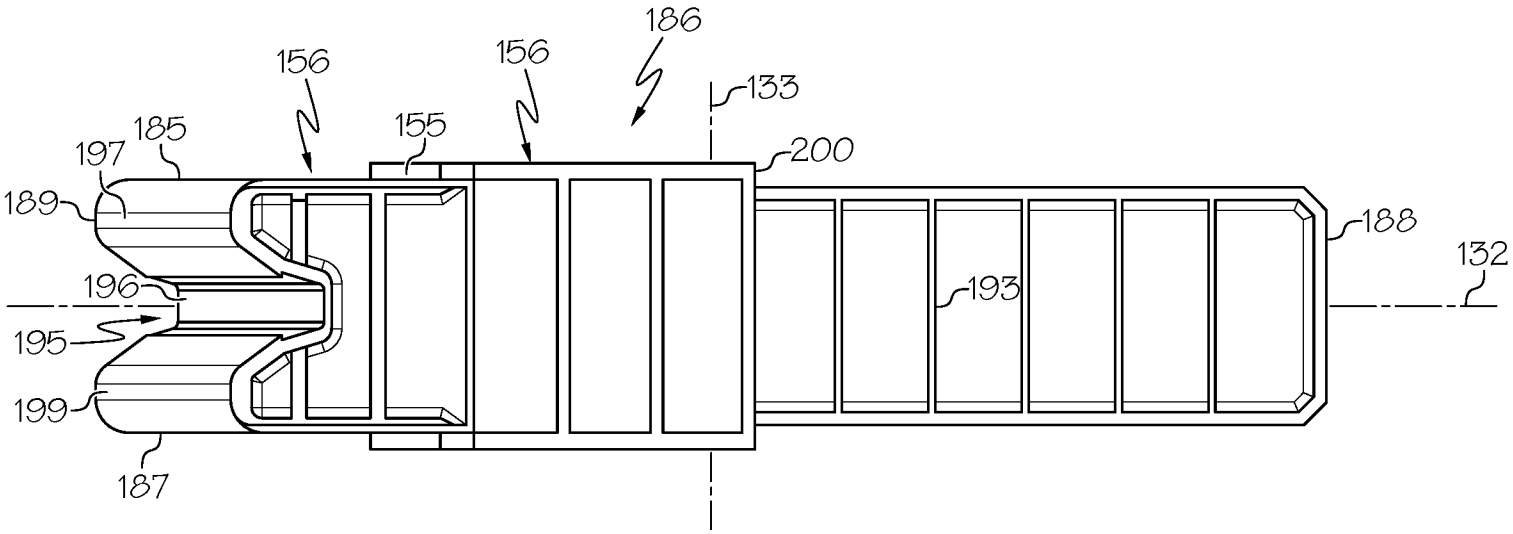
FIG. 4 is a side view of the plug member of FIG. 3.
Figure 5:
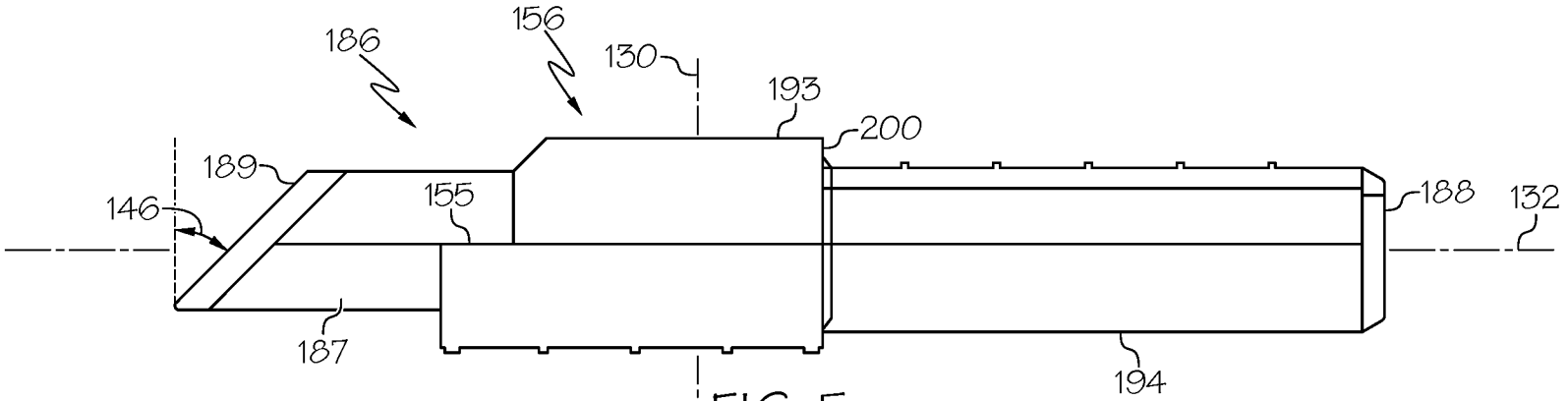
FIG. 5 is a front view of the plug member of FIG. 3.

The first stile 116 may further include a corner reinforcement plug 186. Embodiments of the plug 186 are illustrated in FIGS. 3-5 according to example embodiments. As shown, the plug 186 may be a unitary and monolithic member that extends substantially straight along the axis 132 between a first end 188 (an insert end) and a second end 189 (a corner end). The plug 186 may have an outer profile or margin generally defining a plurality of sides, such as a first side 191, a second side 192, a third side 193, and a fourth side 194, which extend between the first and second ends 188, 189. Adjacent ones of the sides 191, 192, 193, 194 may be substantially orthogonal to each other about the vertical axis 132. The first and second sides 191, 192 may face in opposite directions and may be orthogonal to the axis 133.

The first and second sides 191, 192 may be mirror images of each other across the axis 132. The third and fourth sides 193, 194 may face in opposite directions and may be orthogonal to the axis 130 with the third side 193 facing centrally toward the central portion 115 and the fourth side 194 outwardly toward the stile profile member 150.

In some embodiments, the first and second sides 191, 192 may include a plurality of flat and planar surfaces. Also, the third and fourth sides 193, 194 may include a plurality of recesses or openings that define respective ribs 198. The ribs 198 may be relatively thin-walled, may be orthogonal to the axis 132. Because of the ribs 198, the plug 186 may have a plurality of walls with substantially consistent wall thickness for facilitating manufacture of the plug 186 as will be discussed.

The first end 188 may be generally flat and smooth and may be disposed substantially orthogonal to the axis 132, except that the outer margins of the first end 188 may be chamfered or sloped (FIGS. 4 and 5). The first end 188 may be rectangular.

Figure 7:
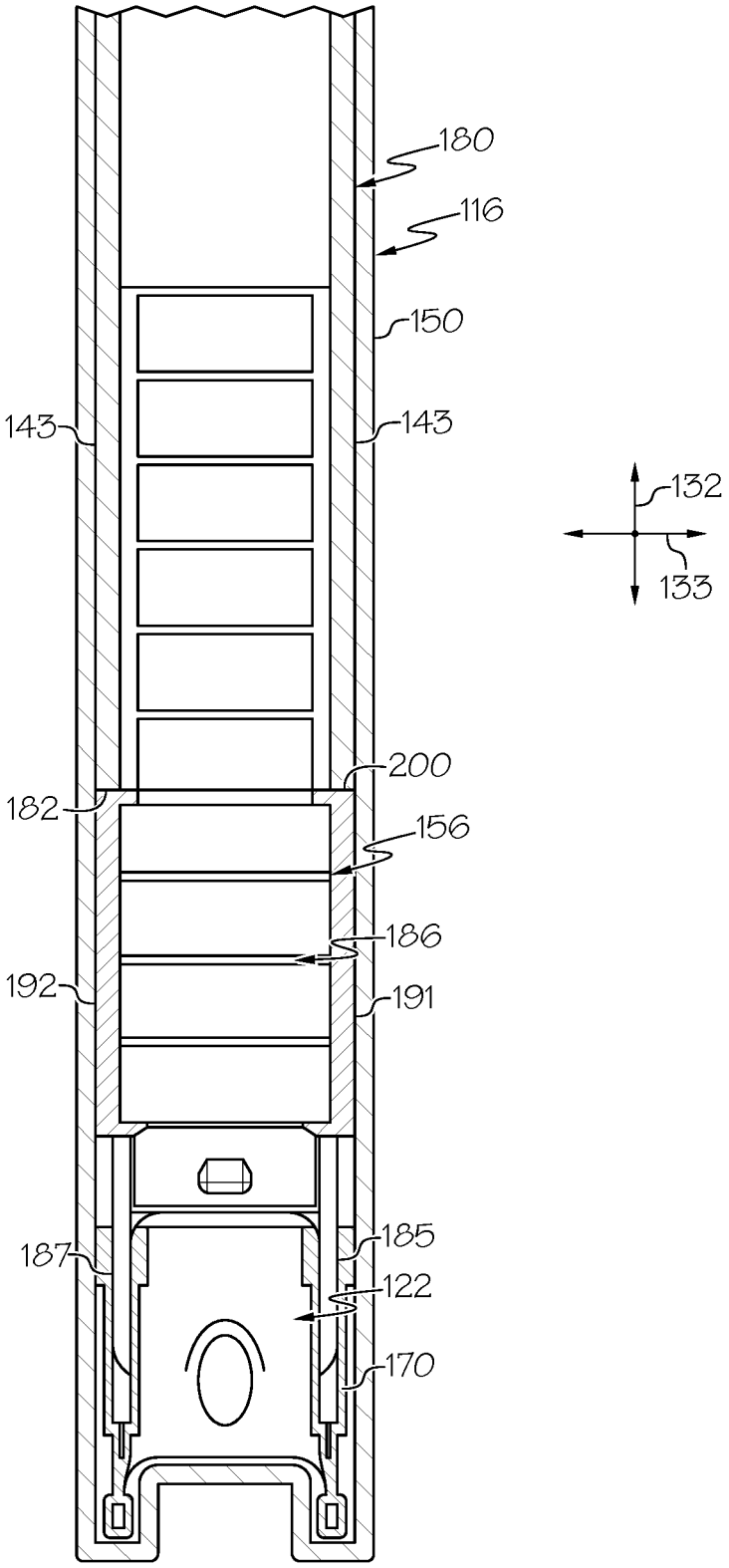
FIG. 7 is a side sectional view of the fenestration unit taken along the line 7-7 of FIG. 1 according to example embodiments.

The second end 189 may include a terminal surface disposed substantially at the miter angle 146 relative to the axis 130. The second end 189 may also include one or more engagement features configured to engage with the engagement face 160 of the corner key 122. The second end 189 may include an aperture 195. The aperture may define a groove 196, which is configured to receive the projection 164 (i.e., the ridge 167) of the corner key 122. As shown in FIG. 2, the groove 196 may include an inner surface 131 that abuts against the ridge 167 to be supported thereon. It will be appreciated that, in additional embodiments having an opposite configuration, the plug 186 may include a projection that is received in the corner key 122 without departing from the scope of the present disclosure. In some embodiments, the groove 196 may be linear and straight so as to extend along the miter angle 146. The groove 196 may extend continuously along the second end 189 and may be open at the third side 193 and the fourth side 194. The groove 196 may also be substantially centered on the second end 189. Accordingly, as shown in FIGS. 3 and 4, the second end 189 may have a cleaved arrangement (i.e., may be cloven) with the groove 196 separating a first end portion 197 from a second end portion 199 thereof. The first and second end portions 197, 199 may be rounded as shown in FIG. 3 so as to guide the ridge 167 into the groove 196 during assembly. When compressed against the engagement face 160 along the axis 132, the first and second end portions 197, 199 may straddle the ridge 167. In some embodiments, the first and second end portions 197, 199 may overlie against the opposing sides of the engagement face 160. Additionally, the second end 189 may include a first wall surface 185 and second wall surface 187 that are flat and planar and that face along the interior-exterior axis 133 in opposite directions. The first and second wall surfaces 185, 187 may extend respectively from the first and second end portions 197, 199 of the second end 189 along the axis 132. As shown in FIGS. 2 and 7, the second end 189 may be received within the edge wall 170 of the corner key 122, and in this position, the edge wall 170 may overlie and may be closely adjacent the first and second wall surfaces 185, 187. In some embodiments, the first and second wall surfaces 185, 187 may abut against the edge wall 170.

Furthermore, the plug 186 may include an intermediate portion 156. The intermediate portion 156 may be wider than the first end 188 and the second end 189. The width of the intermediate portion 156 may be greater than the first and second ends 188, 189 as measured between the first side 191 and the second side 192 and/or as measured between the third side 193 and the fourth side 194. Accordingly, a shoulder 200 may be defined at a transition between the first end 188 and the intermediate portion 156. Also, an uneven edge 155 (e.g., a sawtooth-shaped edge, etc.) may be defined at the transition between the second end 189 and the intermediate portion 156.

The plug 186 may be a unitary, one-piece member. The plug 186 may be composed, comprised, and/or made from a polymeric material (e.g., high-density polyethylene (HDPE), polyvinyl chloride (PVC), polyethylene terephthalate glycol (PETG), Styrene, etc.) in some embodiments. In additional embodiments, the plug 186 may be composed, comprised, and/or made from wood product. In further embodiments, the plug 186 may be formed of metal or a composite material (e.g., glass-filled nylon).

In some embodiments, the plug 186 may be an injection-molded article (i.e., formed via an injection molding process). The plug 186 may include one or more features for facilitating the injection-molding process. For example, the plug 186 may comprise a plurality of relatively thin walls that have a consistent thickness due to the ribs 198 and the recesses defined therebetween, and this construction may facilitate the injection molding process. The edge 155 may also define a parting line for molds of the injection molding process. It will be appreciated that the injection molding process may be relatively low-cost and suitable for repeatable and accurate manufacturing.

For example, the plug 186 may be comprised of, constructed from, and/or made from a polymeric material, and the beam 180 may be constructed from a metallic material. Accordingly, the material of the plug 186 may be different from that of the reinforcement beam 180. The plug 186 may be constructed from a material having higher flexibility than that of the reinforcement beam 180; however, the plug 186 and the reinforcement beam 180 may be generally rigid and strong articles for supporting the panel 104.

The first end 188 of the plug 186 may be received (e.g., plugged) within the terminal end 182 of the reinforcement beam 180. The first side 191 and second side 192 may be configured to slide into and/or press-fit within the end 182 of the beam 180. When inserted, the first end 188 may be press-fit and/or frictionally engaged against opposing internal surfaces of the beam 180. In some embodiments, when fully inserted, the edge of the terminal end 182 may butt up (abut) against the shoulder 200. Accordingly, the plug 186 may engage the beam 180 and support loads directed along the vertical axis 132. Also, during assembly, the shoulder 200 may limit insertion of plug 186 within the reinforcement beam 180 for providing manufacturing advantages. For example, the assembly may be less prone to assembly errors because the plug 186 may self-seat in the desired position relative to the beam 180 due to the abutment against the shoulder 200.

Additionally, the second end 189 may be received within the outer wall 170 of the corner key 122 with the opposing vertical surfaces in contact and/or being closely adjacent. The groove 196 may receive the ridge 167.

Furthermore, as shown in FIG. 7, the first side 191 and the second side 192 of the intermediate portion 156 may be substantially flush (i.e., co-planar) with the adjacent outer surfaces 143 of the reinforcement beam 180. Accordingly, the internal planar surfaces of the interior 158 of the stile profile member 150 may overlie and may be closely adjacent the flush first and second sides 191, 192 and the outer surfaces 143. As shown in FIGS. 6 and 7, there may be little, if any, spacing and flexure of the stile profile member 150 may be supported robustly by the beam 180 and the plug 186.

Accordingly, the plug 186 may help distribute loads relatively evenly proximate the corner of the frame 110. The plug 186 may distribute loads that pass between the reinforcement beam 180, the corner key 122, and the stile profile member 150. The plug 186 may distribute loads from the reinforcement beam to the corner key 122 evenly. Stress concentrations, point loading conditions, etc. may be avoided. Furthermore, the construction may allow for a degree of flexure, bending, and/or other loads that are well within structural limits of the unit. Thus, the plug 186 may make the frame 110 and the panel 104 highly robust.

Furthermore, the frame 110 may be highly robust as well as aesthetically pleasing. The profile members 140, 150 may provide the fenestration unit 102 with aesthetic appeal. Also, the components of the frame 110 may be compactly packaged for a low-profile and aesthetically pleasing appearance.

Manufacturing of the frame 110 and the panel 104 may also be improved due to the plug 186. As mentioned, the plug 186 may be injection molded, which may improve manufacturability. The reinforcement beam 180 may be roll-formed and/or the stile profile member 150 may be extruded for high manufacturing efficiency.

During assembly of the frame 110 of the panel 104, in one example, the first stile 116 may be constructed by installing the stile profile member 150 over the reinforcement beam 180. The plug 186 may be inserted into the stile profile member 150, and the first end 188 of the plug 186 may be inserted into the terminal end 182 of the reinforcement beam 180 until the shoulder 200 contacts the terminal end 182. An upper plug 202 (FIG. 1) may be included that is similar to the lower plug 186, and the upper plug 202 may be similarly inserted at the top end of the reinforcement beam 180. The size and configuration of the plugs 186, 202 may ensure that the reinforcement beam 180 is substantially centered vertically within the profile member 150 along the axis 132. The lower corner key 122 may be inserted in the lower end of the profile member 150. The lower corner key 122 may receive and engage the second end 189 of the plug 186 as discussed above. The construction may be joined to the rail 114 such that the mitered ends 144, 154 abut. The profile member 150 may include an opening that communicates with the injection aperture 174, and sealant (e.g., a thermoplastic applied at an elevated temperature) may be injected into the injection aperture 174. The sealant may flow through the passage 174 and around the corner key 122 to seal gap(s) between it and the surrounding components. It will be appreciated that the upper rail 112 and the second stile 118 may be assembled into the frame 110 in a similar manner to the lower rail 114 and the first stile 116, respectively.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A frame for a fenestration unit comprising:

a first elongate frame member extending in a first direction toward a corner of the frame;

a second elongate frame member extending in a second direction that is different from the first direction toward the corner of the frame; and a corner key that is disposed at the corner and that is engaged with both the first elongate frame member and the second elongate frame member, the second elongate frame member including:

a profile member defining an interior;

an elongate reinforcement beam disposed within the interior, the elongate reinforcement beam having a terminal end; and a corner reinforcement plug with an insert end that is received in the terminal end of the elongate reinforcement beam, a corner end that is engaged with the corner key, and an intermediate portion extending along the second direction between the insert end and the corner end, the corner reinforcement plug having a shoulder defined between the intermediate portion and the insert end, the shoulder abutting against the terminal end and the intermediate portion disposed within the interior of the profile member.

2. The frame of claim 1, wherein the corner end includes an aperture configured to receive a projection of the corner key.

3. The frame of claim 2, wherein the aperture is a straight, linear groove.

4. The frame of claim 2, wherein the projection is a straight, linear ridge.

5. The frame of claim 2, wherein the corner end includes a cleaved arrangement with the aperture separating a first end portion of the corner end from a second end portion of the corner end.

6. The frame of claim 2, wherein the aperture is a straight, linear groove and the projection is a straight linear ridge, the groove and the projection both correspondingly disposed at a miter angle relative to the first direction.

7. The frame of claim 6, wherein the corner key includes an edge wall that receives the corner end of the plug.

8. The frame of claim 1, wherein the intermediate portion includes an intermediate surface, and the profile member includes an overlying surface that overlies the intermediate surface to be supported thereby.

9. The frame of claim 8, wherein the elongate reinforcement beam includes a side surface that is substantially flush with the intermediate surface, and wherein the overlying surface overlies the intermediate surface and the side surface to be supported thereby.

10. The frame of claim 9, wherein the frame extends about an interior-exterior axis of the fenestration unit, and wherein the side surface and the intermediate surface face along the interior-exterior axis.

11. The frame of claim 1, wherein the corner key and the elongate reinforcement beam are constructed of different materials.

12. The frame of claim 1, wherein the frame is a panel frame of a panel of the fenestration unit, and the panel frame supports a central portion of the panel, the panel frame configured for sliding movement within an exterior frame of the fenestration unit.

13. A method of manufacturing a fenestration unit comprising:

providing a corner key of a frame of the fenestration unit;

engaging the corner key of a frame of the fenestration unit with a first elongate frame member so that the first elongate frame member extends from the corner key in a first direction; and engaging a second elongate frame member with the corner key so that the second elongate frame member is joined with the first elongate frame member via the corner key, the corner key disposed at a corner of the frame, the second elongate frame member extending from the corner key in a second direction that is different from the first direction, the second elongate frame member including:

a profile member defining an interior;

an elongate reinforcement beam disposed within the interior, the elongate reinforcement beam having a terminal end; and a corner reinforcement plug with an insert end that is received in the terminal end of the elongate reinforcement beam, a corner end that is engaged with the corner key, and an intermediate portion extending along the second direction between the insert end and the corner end, the corner reinforcement plug having a shoulder defined between the intermediate portion and the insert end, the shoulder abutting against the terminal end and the intermediate portion disposed within the interior of the profile member.

14. The method of claim 13, wherein the corner end includes an aperture, and further comprising engaging the corner end with the corner member by receiving a projection of the corner key in the aperture.

15. The method of claim 14, wherein the corner end includes a cleaved arrangement with the aperture separating a first end portion of the corner end from a second end portion of the corner end.

16. The method of claim 13, wherein the intermediate portion includes an intermediate surface, and further comprising overlying an overlying surface of the profile member over the intermediate surface to be supported thereby.

17. The method of claim 16, wherein the elongate reinforcement beam includes a side surface that is substantially flush with the intermediate surface, and further comprising overlying the intermediate surface and the side surface to be supported thereby.

18. The method of claim 13, further comprising forming the corner reinforcement plug to be unitary and monolithic.

19. The method of claim 18, further comprising injection molding the corner reinforcement plug.

20. A panel for a fenestration unit comprising:

a central portion; and a panel frame that extends about the central portion and that supports the central portion, the panel frame including:

a first elongate frame member extending in a first direction toward a corner of the panel frame;

a second elongate frame member extending in a second direction that is different from the first direction toward the corner of the panel frame, the projection disposed at a nonzero miter angle relative to the first direction and the second direction; and a corner key that is disposed at the corner and that is engaged with both the first elongate frame member and the second elongate frame member, the second elongate frame member including:

a profile member defining an interior;

an elongate reinforcement beam disposed within the interior, the elongate reinforcement beam having a terminal end; and a corner reinforcement plug with an insert end that is received in the terminal end of the elongate reinforcement beam, a corner end with an aperture that receives the projection to engage the corner key, and an intermediate portion extending along the second direction between the insert end and the corner end, the corner reinforcement plug having a shoulder defined between the intermediate portion and the insert end, the shoulder abutting against the terminal end, and the intermediate portion disposed within the interior of the profile member.

* * * * *